US008336130B1

(12) United States Patent
Cardenas

(10) Patent No.: US 8,336,130 B1
(45) Date of Patent: Dec. 25, 2012

(54) TOILET DEVICE WITH LIFTING CAPABILITY

(76) Inventor: Mario A. Cardenas, Palmetto, FL (US)

( * ) Notice: Subject to any disclaimer, the term of this patent is extended or adjusted under 35 U.S.C. 154(b) by 659 days.

(21) Appl. No.: 12/470,459

(22) Filed: May 21, 2009

(51) Int. Cl.
*A47K 13/10* (2006.01)

(52) U.S. Cl. ..... 4/667; 4/252.1; 4/420; 4/901; 4/252.2; 4/252.3

(58) Field of Classification Search ..... 4/901, 420, 4/252.1–252.3, 667
See application file for complete search history.

(56) References Cited

U.S. PATENT DOCUMENTS 3,060,458 A 10/1962 Burke
3,473,174 A 10/1969 Cool
4,160,295 A * 7/1979 Putyra ..... 4/661
4,168,552 A 9/1979 Austin
4,777,671 A * 10/1988 Kearns ..... 4/667
4,947,493 A * 8/1990 Salonica ..... 4/476
5,027,446 A 7/1991 Robertson
5,031,251 A * 7/1991 Williams et al. ..... 4/420
5,063,617 A 11/1991 Ward et al.
5,566,401 A * 10/1996 Kishi et al. ..... 4/300
5,592,703 A 1/1997 Jones et al.
D383,835 S 9/1997 Gibbs
5,737,780 A 4/1998 Okita et al.
6,553,582 B1 * 4/2003 Clark ..... 4/252.2
6,553,585 B1 4/2003 Lundstrom
6,745,417 B2 6/2004 Sumino

* cited by examiner

*Primary Examiner* — Gregory Huson
*Assistant Examiner* — Lauren Heitzer

(57) ABSTRACT

A toilet device that can be raised or lowered comprising a generally flat base atop a floor; a toilet bowl disposed above the base via a hydraulic lift cylinder, wherein the hydraulic lift cylinder can move the toilet bowl between an up position where the toilet bowl is raised upwardly away from the floor and a down position wherein the toilet bowl is lowered toward the floor; one or more telescopic support rods for supporting the toilet bowl above the base; a waste pipe fluidly connecting the toilet bowl to a waste line of the plumbing system; and a control device operatively connected to the hydraulic lift cylinder for causing the hydraulic lift cylinder to move the toilet bowl to the up position or the down position.

7 Claims, 6 Drawing Sheets

(DOWN POSITION)

(DOWN POSITION)

(UP POSITION)

TOILET DEVICE WITH LIFTING CAPABILITY

FIELD OF THE INVENTION

The present invention is directed to a toilet, more particularly to a toilet comprising a hydraulic lift system to allow the toilet bowl and toilet seat to be lifted and lowered according to a user's needs.

BACKGROUND OF THE INVENTION

Some individuals, such as elderly or disabled persons, may have difficulty lifting themselves on an off a standard toilet. The present invention features a toilet device that has the ability to be lifted and lowered to enable a user to easily use the toilet.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
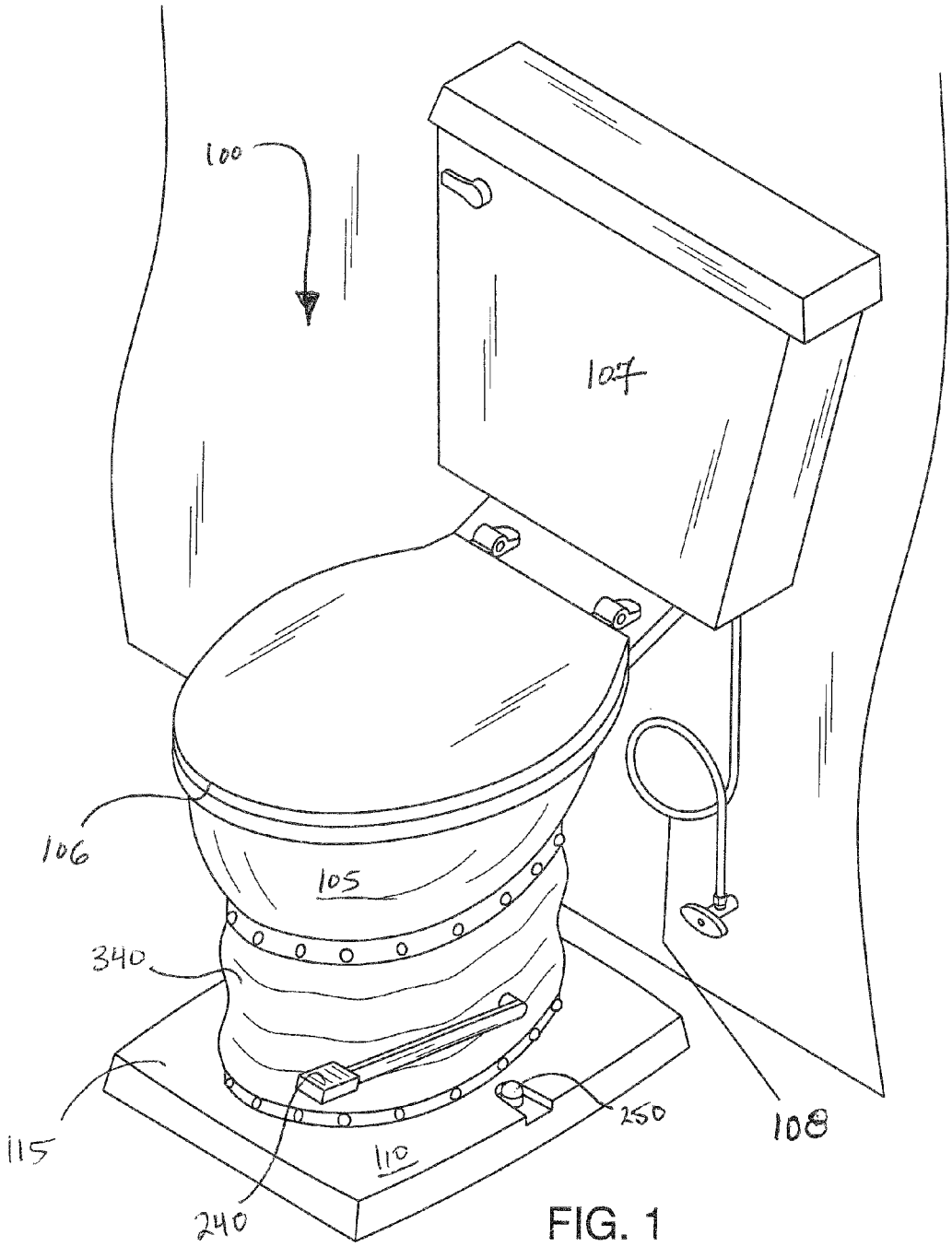
FIG. 1 is a perspective view of the toilet device of the present invention.
Figure 2:
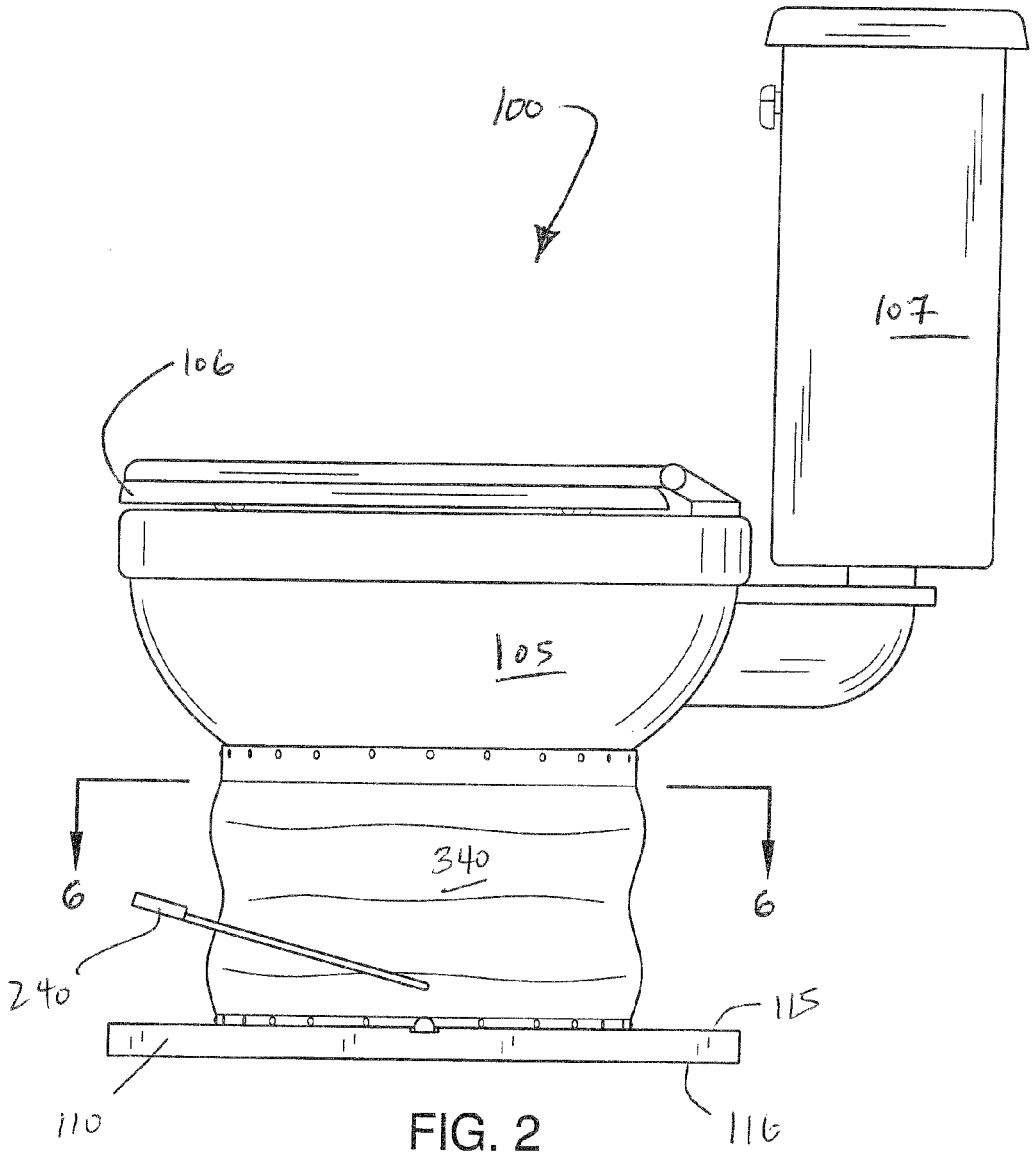
FIG. 2 is a first side view of the toilet device of the present invention, wherein the toilet device is in the down position.
Figure 3:
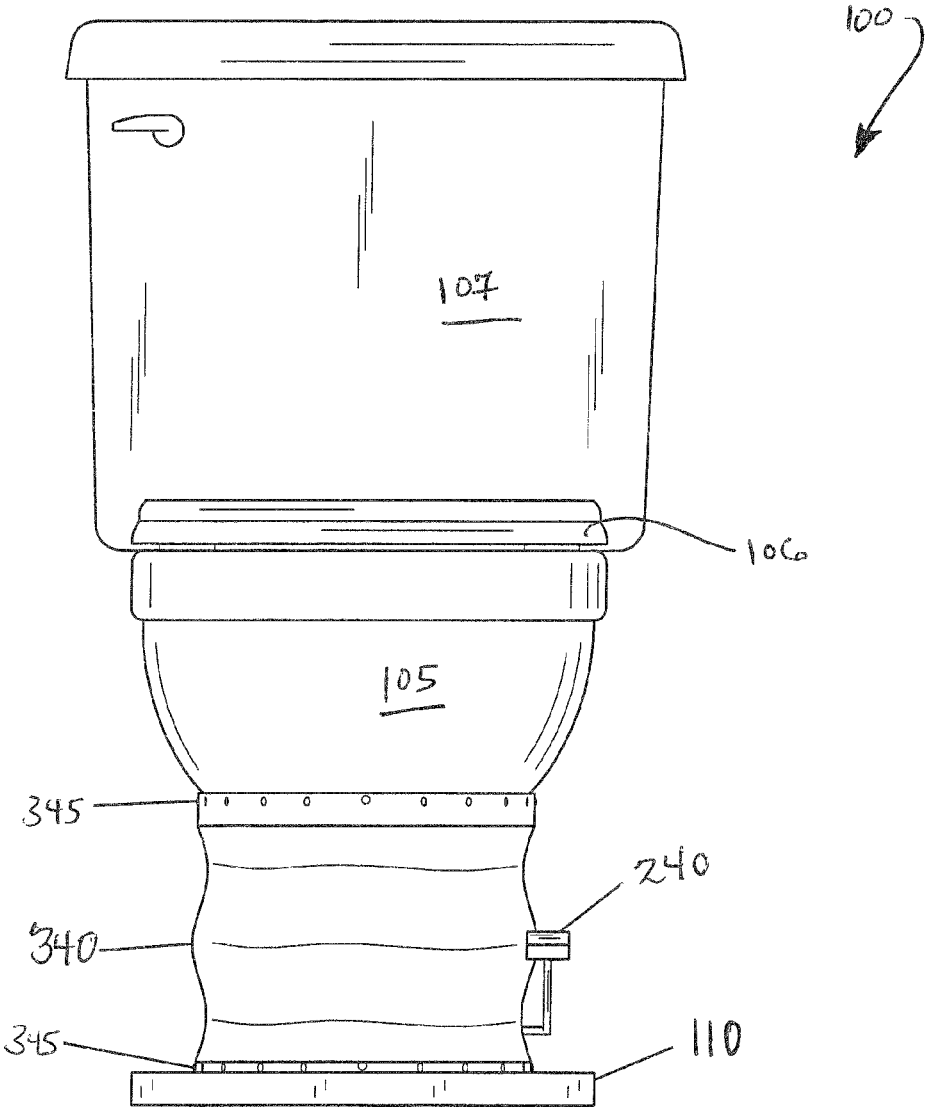
FIG. 3 is a front view of the toilet device of the present invention, wherein the toilet device is in the down position.
Figure 4:
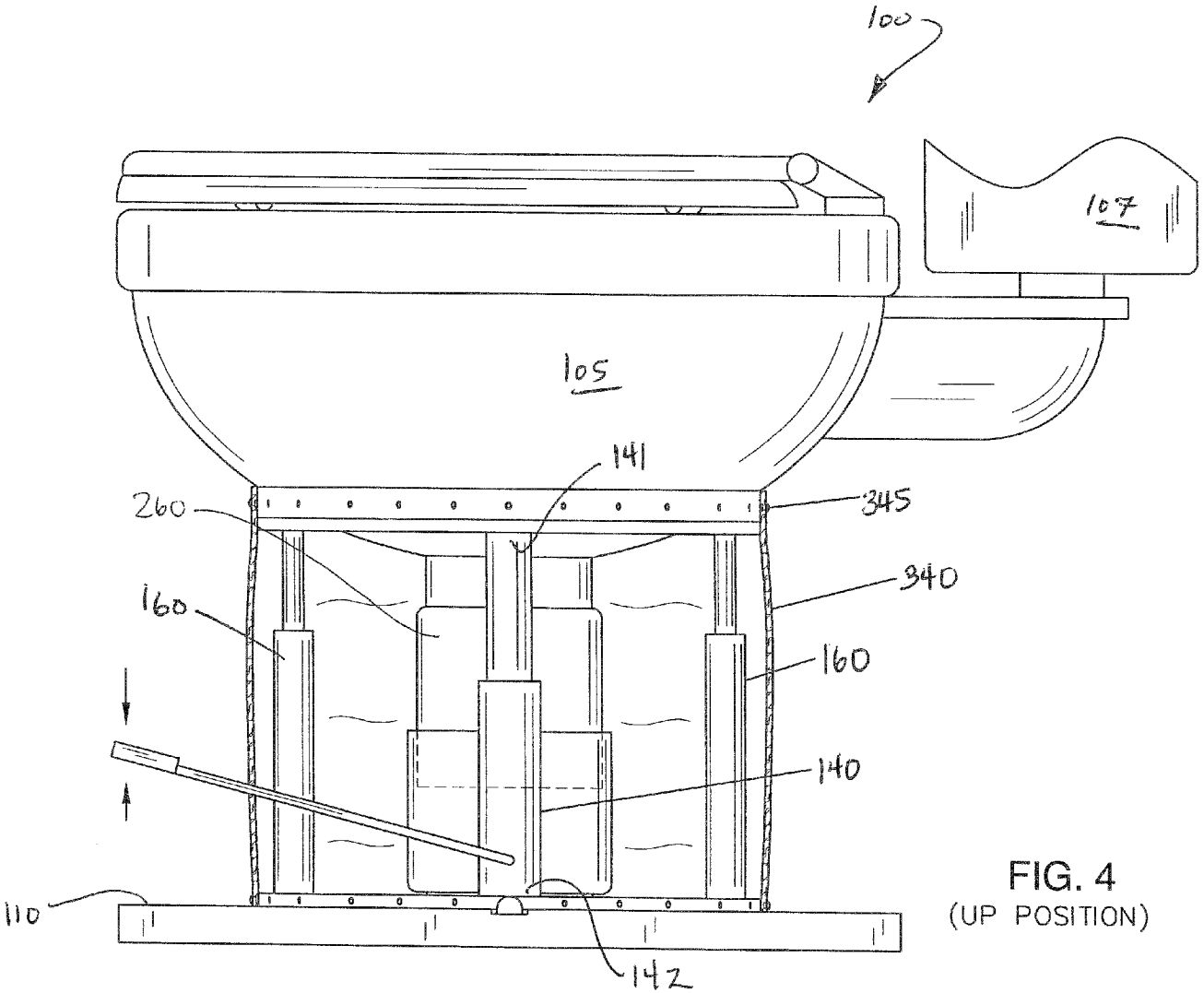
FIG. 4 is a first side view of the toilet device of the present invention, wherein the toilet device is in the up position.

The following is a listing of numbers corresponding to a particular element refer to herein:

100 toilet device
105 toilet bowl
106 toilet seat
107 toilet reservoir
108 water supply line
109 bottom region of toilet bowl
110 base
115 top surface of base
116 bottom surface of base
140 hydraulic lift cylinder
141 first end of lift cylinder
142 second end of lift cylinder
20.1 waste line of plumbing system
210 waste pipe
240 pedal
250 switch
260 coupling
340 outer cover
345 cover fastener Referring now to FIGS. 1-6, the present invention features a toilet device 100 that can raise or lower the toilet bowl 105 and toilet seat 106 according to a user's needs. The toilet device 100 can provide assistance to a user with limited strength or physical abilities.

The toilet device 100 resembles a conventional toilet. For example, the toilet device 100 comprises a toilet bowl 105, a toilet seat 106, a toilet reservoir 107, and a water supply line 108. The toilet device 100 can move between an up position and a down position. In the down position, the toilet bowl 105 is lowered close to the floor.

In the up position, the toilet bowl 105 is raised upwardly away from the floor to increase the height of the toilet device 100.

The toilet device 100 comprises generally flat base 110. The base 110 has a top surface 115 and a bottom surface 116. The toilet bowl 105 is raised above the base 100 via a hydraulic lift cylinder 140. The hydraulic lift cylinder 140 can move the toilet bowl between the up position and the down position. Such hydraulic lift cylinders are well known to one of ordinary skill in the art. In some embodiments, the hydraulic lift cylinder 140 is oriented near a first side edge of the base 110. In some embodiments, the hydraulic lift cylinder 140 is oriented near a front edge of the base 110. The lift cylinder 140 is not limited to these locations with respect to the base 110. They hydraulic lift cylinder 140 is operatively connected to a power source.

In some embodiments, the toilet bowl 105 has a top edge, a side, and a bottom region 109. In some embodiments, the first end 141 of the hydraulic lift cylinder 140 is attached to the toilet bowl 105 near the side and the second end 142 of the hydraulic lift cylinder 140 is attached to the top surface 115 of the base 110.

In some embodiments, one or more support rods 160 support the toilet bowl 105 above the base 110 (e.g., the top surface 115 of the base 110). In some embodiments, the support rods 160 are constructed from an inner bar telescopically received in an outer bar. The inner bar can slide up and down inside the outer bar when the toilet bowl is moved to the up position or to the down position, respectively. Such support rods are well known to one of ordinary skill in the art.

Figure 5:
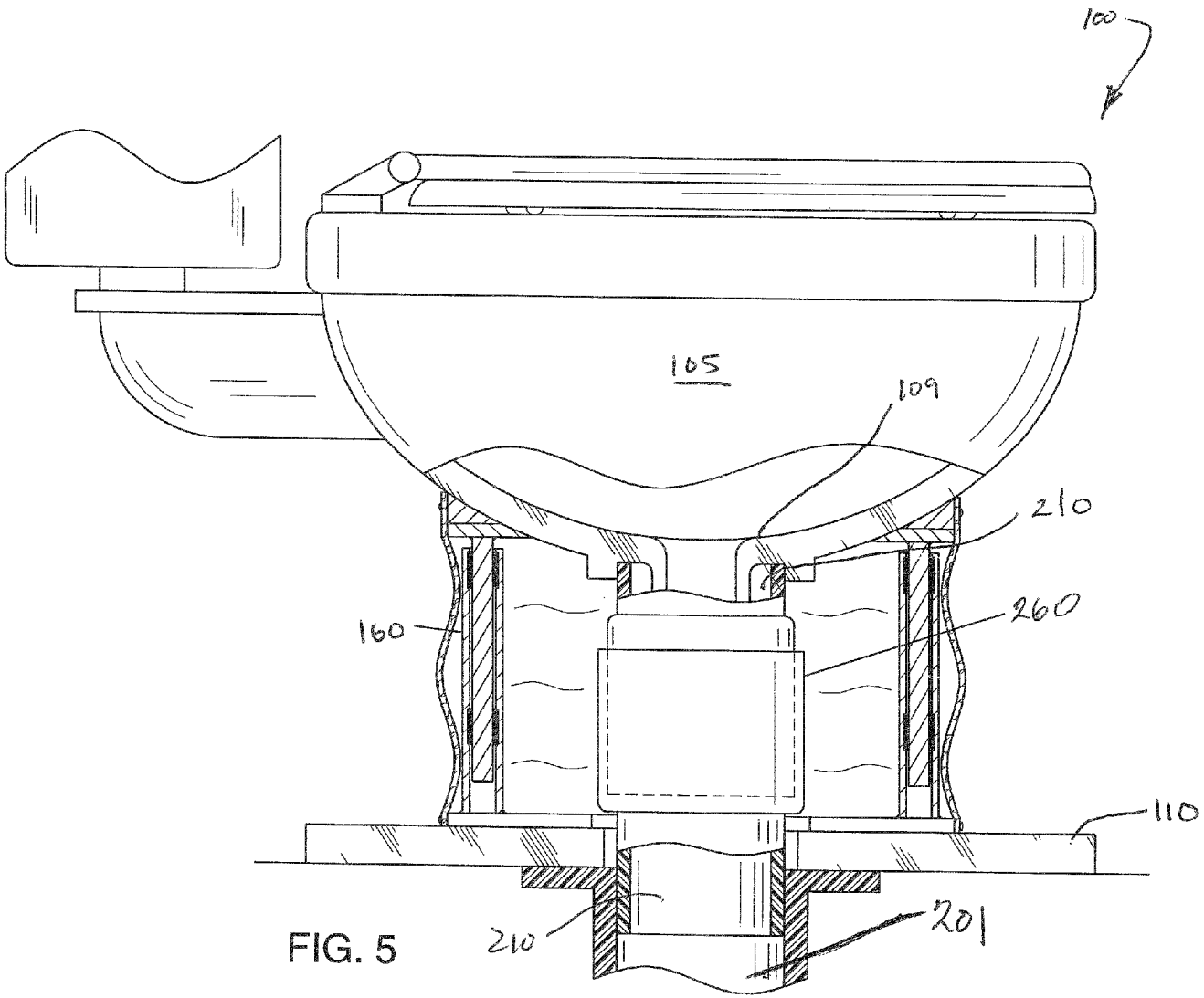
FIG. 5 is a second side view of the toilet device of the present invention.
Figure 6:
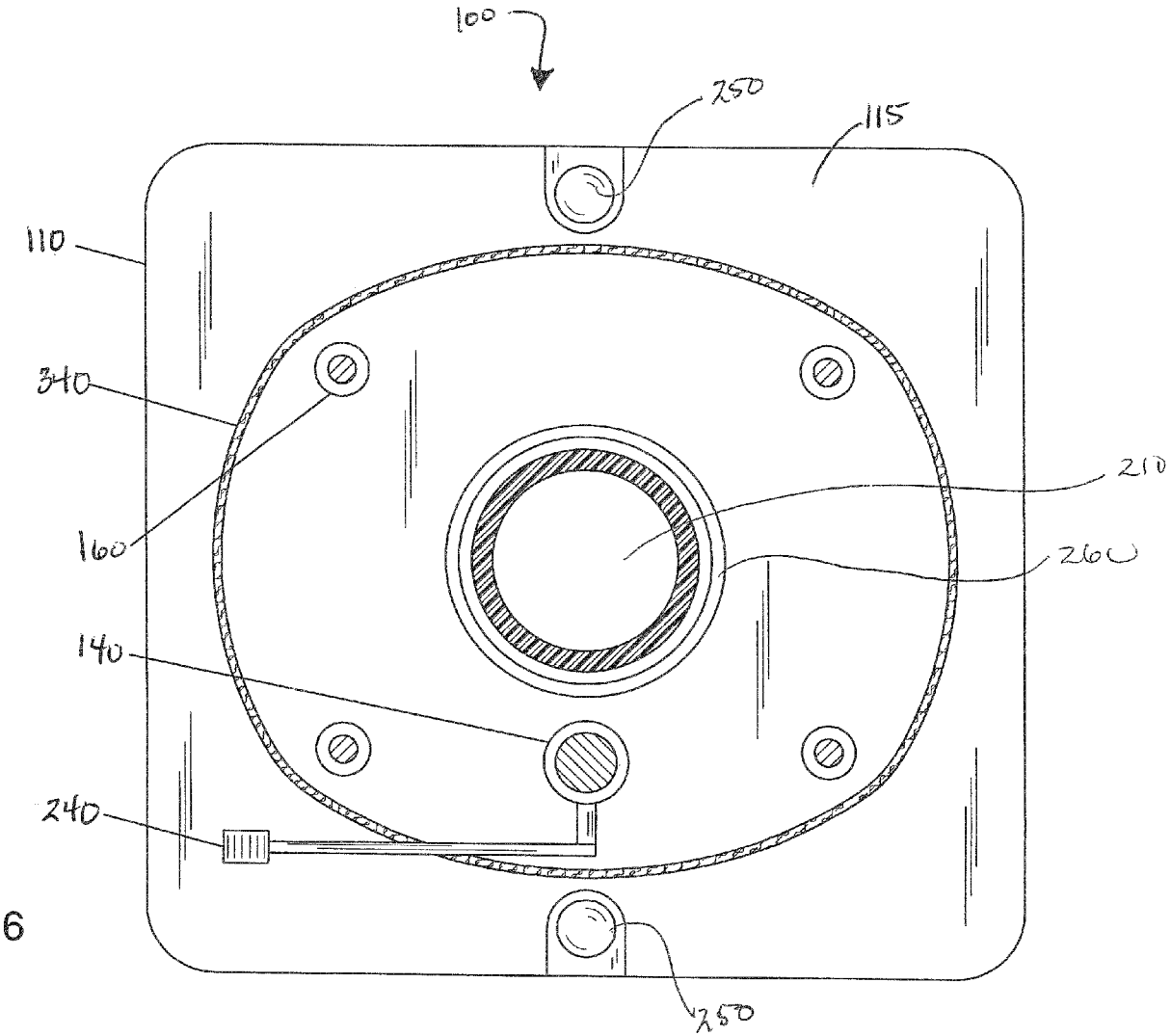
FIG. 6 is a top cross sectional view of the toilet device of the present invention.

A waste pipe 210 fluidly connects the toilet bowl 105 (e.g., the bottom region 109 of the toilet bowl 105) and the waste line 201 of the plumbing system (see FIG. 5). A coupling 260 may surround the waste pipe 210 (see FIG. 5).

In some embodiments, an outer cover 340 surrounds the hydraulic lift cylinder 140 and the waste pipe 210. The outer cover 340 may be attached to the toilet bowl 105 and/or the base 110 via an attachment means. An attachment means may include a fastener 345, a hook-and-loop fastener, a zipper mechanism, a hook mechanism, a button mechanism, the like, or a combination thereof. In some embodiments, the outer cover 340 is constructed from a material comprising corrugated rubber bellows. The outer cover 340 is not limited to being constructed from corrugated rubber bellows.

The toilet device 100 can be moved between the up position and the down position via a control device, for example a pedal 240 or a switch 250. The hydraulic lift cylinder 140 may be operatively/electrically connected to the control device (e.g., pedal 240 and/or switch 250). The control device can move between a first position and a second position. In some embodiments, the first position corresponds to causing the hydraulic lift cylinder 140 to move the toilet bowl 105 to the up position. In some embodiments, the second position corresponds to causing the hydraulic lift cylinder 140 to move the toilet bowl 105 to the down position.

The following the disclosures of the following U.S. Patents are incorporated in their entirety by reference herein: U.S. Pat. No. 6,745,417; U.S. Pat. No. 5,027,446; U.S. Pat. No.

5,063,617; U.S. Pat. No. 3,060,458; U.S. Pat. No. 4,168,552; U.S. Pat. No. 5,737,780; U.S. Pat. No. 3,473,174; U.S. Pat. No. 5,592,703; U.S. Pat. No. 6,553,585.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A toilet device that can be raised or lowered, said toilet device comprising:

(a) a generally flat base atop a floor;

(b) a toilet bowl disposed above the base via a hydraulic lift cylinder, wherein a first end of the hydraulic lift cylinder is attached to a side of the toilet bowl and a second end of the hydraulic lift cylinder is attached to a top surface of the base; wherein the hydraulic lift cylinder can move the toilet bowl between an up position where the toilet bowl is raised upwardly away from the floor and a down position wherein the toilet bowl is lowered toward the floor;

(c) a plurality of telescopic support rods attached to both the top surface of the base and to the toilet bowl, the support rods are for rigidly supporting the toilet bowl above the base in a horizontal plane between an up position where the toilet bowl is raised upwardly in a vertical plane away from the floor and a down position wherein the toilet bowl is towered in a vertical plane toward the floor;

(d) a waste pipe fluidly connecting the toilet bowl to a waste line of the plumbing system; and (e) a control device operatively connected to the hydraulic lift cylinder, wherein the control device is moved to a first position to cause the hydraulic lift cylinder to move the toilet bowl to the up position and the control device is moved to a second position to cause the hydraulic lift cylinder to move the toilet bowl to the down position.

2. The toilet device of claim 1, wherein the hydraulic lift cylinder is operatively connected to a power source.

3. The toilet device of claim 1, wherein the control device is a pedal or a switch.

4. The toilet device of claim 1, wherein an outer cover surrounds the hydraulic lift cylinder and the waste pipe.

5. The toilet device of claim 4, wherein the outer cover is attached to the toilet bowl and to the base via an attachment means.

6. The toilet device of claim 5, wherein the attachment means includes a fastener, a hook-and-loop fastener, a zipper mechanism, a hook mechanism, a button mechanism, or a combination thereof.

7. The toilet device of claim 4, wherein the outer cover is constructed from a material comprising corrugated rubber bellows.

* * * * *